US007367069B2

(12) United States Patent
Connell et al.

(10) Patent No.: US 7,367,069 B2
(45) Date of Patent: May 6, 2008

(54) LIFTING MECHANISM FOR A BED DECK

(76) Inventors: Michelle D. Connell, 4018 Highway 34, Wheatland, WY (US) 82201; Fred M. Meyer, 4016 Highway 34, Wheatland, WY (US) 82201; Douglas S. Meyer, 4018 Highway 34, Wheatland, WY (US) 82201; Frank L. O'Brein, 4499 Pursel Dr., Casper, WY (US) 82604

( * ) Notice: Subject to any disclaimer, the term of this patent is extended or adjusted under 35 U.S.C. 154(b) by 6 days.

(21) Appl. No.: 10/855,057

(22) Filed: May 27, 2004

(65) Prior Publication Data

US 2005/0081293 A1 Apr. 21, 2005

Related U.S. Application Data

(63) Continuation-in-part of application No. 10/391,091, filed on Mar. 18, 2003, now Pat. No. 6,966,080, which is a continuation-in-part of application No. 10/146,153, filed on May 15, 2002, now Pat. No. 6,611,973.

(60) Provisional application No. 60/473,630, filed on May 27, 2003.

(51) Int. Cl.

| | |
|---|---|
| ***A47C 17/40*** | (2006.01) |
| ***E05F 1/08*** | (2006.01) |
| ***E05F 1/14*** | (2006.01) |

(52) U.S. Cl. ..... 5/136; 5/164.1; 5/308

(58) Field of Classification Search ..... 5/9.1, 5/308, 931, 58, 136, 164.1; 16/308, 298

See application file for complete search history.

(56) References Cited

U.S. PATENT DOCUMENTS

| | | | |
|---|---|---|---|
| 120,270 | A | 10/1871 | Hall |
| 239,465 | A | 3/1881 | Delany |

(Continued)

FOREIGN PATENT DOCUMENTS

| | | |
|---|---|---|
| AU | 248019 | 11/1963 |

(Continued)

OTHER PUBLICATIONS

Naval Surface Warfare Center, Carderock Division 8-1A-3, Berth, Transom, Officer, Types L36 & L36-W31, http://www.dt.navy.mil/code97/9780/Furniture%20files/html%20files/b-1a-3.htm, retrieved Feb. 3, 2004.

(Continued)

*Primary Examiner*—Alexander Grosz
(74) *Attorney, Agent, or Firm*—Lathrop & Gage LC

(57) ABSTRACT

A lifting mechanism is disclosed for a bed deck having a top surface where a user may lie thereon and a bottom surface. The bed deck is rotatably mounted to a bed platform having a recessed storage area. The bed deck can be moved from a horizontal to a non-horizontal position. The lifting mechanism is at least partially disposed in the recessed storage area and includes a torsion bar having a first end and a second end; a cam follower rigidly mounted to the torsion bar proximal to the first end; an anchor arm rigidly mounted to the torsion bar proximal to the second end; a mechanism for mounting the torsion bar with the bed platform; and a cam mounted to the bottom surface of the bed deck.

15 Claims, 7 Drawing Sheets

U.S. PATENT DOCUMENTS

| | | | | |
|---|---|---|---|---|
| 251,489 | A | 12/1881 | Ware | |
| 513,190 | A | 1/1894 | Lawson | |
| 669,175 | A | 3/1901 | Lein | |
| 676,215 | A | 6/1901 | Bedell | |
| 839,041 | A | 12/1906 | Schwab | |
| 855,058 | A | 5/1907 | Jamison et al. | |
| 900,156 | A | 10/1908 | Enell | |
| 1,077,199 | A | 10/1913 | James | |
| 1,231,452 | A | 6/1917 | Sword | |
| 1,253,549 | A | 1/1918 | Weaver | |
| 1,391,566 | A | 9/1921 | Musselman | |
| 1,480,853 | A | 1/1924 | Diamond | |
| 1,865,757 | A | 7/1932 | Honsowetz | |
| 2,145,213 | A | 1/1939 | Herzog | |
| 2,239,877 | A | 4/1941 | Ciuilo | |
| 2,374,641 | A | 5/1945 | Badin | |
| 2,593,567 | A | 4/1952 | Keck | |
| 2,692,009 | A | 10/1954 | Warshaver | |
| 2,698,445 | A | 1/1955 | More | |
| 2,708,755 | A | 5/1955 | Wilkinson, Jr. | |
| 2,945,241 | A | 7/1960 | Sideroff | |
| 2,945,242 | A | 7/1960 | Heiden | |
| 2,953,792 | A | 9/1960 | Fleischer | |
| 3,311,932 | A | 4/1967 | Ahola | |
| 3,737,925 | A | 6/1973 | Oxford | |
| 3,878,573 | A | 4/1975 | Boudewyn | |
| 3,879,796 | A | 4/1975 | Whyte | |
| 4,084,276 | A | 4/1978 | Trexler, Jr. et al. | |
| 4,179,763 | A | 12/1979 | Echavarren et al. | |
| 4,219,177 | A | 8/1980 | O'Day | |
| 4,259,755 | A | 4/1981 | Hollander | |
| 4,312,086 | A | 1/1982 | Bianco | |
| 4,360,936 | A | 11/1982 | Keller | |
| 4,553,278 | A * | 11/1985 | Drexhage | 5/136 |
| 4,555,821 | A | 12/1985 | Page | |
| 4,571,775 | A | 2/1986 | Leonard | |
| 4,686,727 | A | 8/1987 | Wilkinson | |
| 4,745,643 | A | 5/1988 | Clarke | |
| RE32,878 | E * | 2/1989 | Leonard | 16/298 |
| 4,811,438 | A | 3/1989 | Simpson | |
| 4,928,332 | A | 5/1990 | Ogden et al. | |
| 5,003,650 | A | 4/1991 | Caya | |
| 5,020,173 | A | 6/1991 | Dreyer, Jr. | |
| D342,393 | S | 12/1993 | Cephas | |
| 5,621,930 | A * | 4/1997 | Reppas et al. | 5/136 |
| 5,687,435 | A | 11/1997 | Dufresme | |
| 5,794,283 | A | 8/1998 | Villa et al. | |
| 6,088,857 | A | 7/2000 | Ogle | |
| D441,559 | S | 5/2001 | Walsh | |
| 6,314,595 | B1 | 11/2001 | Price | |
| 6,502,255 | B1 | 1/2003 | Perkins et al. | |
| 6,520,460 | B2 | 2/2003 | Hallberg et al. | |
| 7,017,200 | B2 * | 3/2006 | Reppas et al. | 5/2.1 |

FOREIGN PATENT DOCUMENTS

| | | |
|---|---|---|
| DE | 3207953 A1 | 6/1983 |
| FR | 2576761 A1 | 8/1986 |
| GB | 451482 | 8/1936 |

OTHER PUBLICATIONS

NSWC - Carderock Division Furniture Catalog. Model No. B-1A-2, https://90machinery.navsses.navy.mil/habitability/furniture/item.asp?item=13838, retrieved Feb. 3. 2004.

Foodservice Equipment Catalog, https://90machinery.navsses.navy.mil/habitability/furniture/popupllmage.asp?item=13838, retrieved Feb. 3. 2004.

NSWC - Carderock Division Furniture Catalog, Model No. B-1A-3, https://90machinery.navsses.navy.mil/habitability/furniture/item.asp?item=13838, retrieved Feb. 3. 2004.

KLN Steel Products Company Safety Rail, 13500018A, Sep. 7, 2000.

KLN photo.

Complete pleadings for case "*Connell v. KLN Steel Prod. Co.*" in the United States Dictrict Court, Norther District of Illinois, as of Mar. 1, 2007.

Complete File History of related U.S. Appl. No. 10/146,153, filed May 15, 2002, as of Oct. 31, 2007.

Transaction History page from USPTO website for related U.S. Appl. No. 10/146,153, filed May 15, 2002, as of Oct. 31, 2007.

Complete File History of related U.S. Appl. No. 10/931,091, filed Mar. 18, 2003, as of Oct. 31, 2007.

Transaction History page from USPTO website for related U.S. Appl. No. 10/391,091, filed Mar. 18, 2003, as of Oct. 31, 2007.

Initial Publication with ISR from related PCT Patent Application No. PCT/US02/15232, filed May 15, 2002, as of Oct. 31, 2007.

* cited by examiner

LIFTING MECHANISM FOR A BED DECK

RELATED APPLICATIONS

This application is a non-provisional patent application of U.S. provisional patent application Ser. No. 60/473,630, Filed May 27, 2003, entitled "Lifting Mechanism For A Bed Deck" and is a continuation-in-part of U.S. patent Ser. No. 10/391,091, now U.S. Pat. No. 6,966,080 filed Mar. 18, 2003, which is a continuation-in part of U.S. patent Ser. No. 10/146,153, now U.S. Pat. No. 6,611,973, filed 15 May 2002, the disclosures of which are incorporated herein by reference.

BACKGROUND

U.S. Pat. No. 6,611,973 (the '973 patent), filed May 15, 2002, for a "Bed Structure with Storage Area", and assigned to the same assignee as that of the present invention, is incorporated herein by reference. The '973 patent discloses a bed structure with a platform having a recessed storage area and a deck hingedly mounted to the platform such that the same may serve as a surface upon which a user may lie (e.g., for sleeping), and may be rotated upward for access to the storage area. FIG. 1 shows one embodiment of a bed structure 10 having one or more platforms 12 disposed in spaced relation to one another by a set of end frames 14. Each platform 12 has a recessed storage area 16 formed therein by sidewalls 18 of the platform 12. A deck 20 is rotatably mounted to the platform 12 to alternately cover the recessed storage area 16 and provide access to the storage area 16.

Depending on the construction of the deck 20, it may have a weight well over 100 pounds, and in one embodiment of the bed structure 10 the deck 20 weighs over 190 pounds. Not only does this make it difficult to manually rotate the deck 20 upward, but also presents a serious danger of the deck 20 accidentally falling downward if the deck 20 is "propped-up" to hold open the access to the recessed storage area 16. Although lifting mechanisms for such decks 20, such as gas springs, have been proposed for assisting in deck lifting, the high forces needed for upward rotation of the deck 20 from the most downward position would require a very strong gas spring arrangement. Further, gas springs often require maintenance over time and typically wear out within a certain number of cycles. Additionally, these types of lifting mechanisms often do not support holding up the deck 20 at a selected angle of rotation other than a fully "open" position.

SUMMARY

The lifting mechanism herein disclosed advances the art and overcomes problems articulated above by providing a lifting mechanism that moves a bed deck from a substantially horizontal position to a non-horizontal position while requiring minimal force to effect the movement.

In particular, and by way of example only, according to an embodiment, provided is a lifting mechanism for a bed deck, the bed deck being rotatably mounted to a bed platform for movement of the bed deck from a substantially horizontal to a non-horizontal position, including: a torsion bar having a first end and a second end and defining an axis; a cam follower mounted on the torsion bar proximal to the first end; an anchor arm mounted on the torsion bar proximal to the second end; and a cam mounted to the bed deck, wherein a torsional force applied to the torsion bar by rotation of the cam follower about the axis of the torsion bar, relative to a position of the anchor arm, is transferred by the cam follower to the cam to provide a biasing force to the bed deck in the direction of rotation, to move the bed deck from a substantially horizontal to a non-horizontal position.

In another embodiment, provided is lifting mechanism for a bed deck, the bed deck being rotatably mounted to a bed platform for movement of the bed deck from a substantially horizontal to a non-horizontal position, including: a torsion bar defining an axis; a cam follower mounted to the torsion bar; at least one bracket for mounting the lifting mechanism to the bed platform; and a cam mounted to the bed deck wherein a torsional force in the torsion bar generated by a rotation of the cam follower about the axis of the torsion bar is transferred by the cam follower to the cam to provide a biasing force to the bed deck in the direction of rotation thereof from the substantially horizontal to the non-horizontal position.

In yet another embodiment, provided is a lifting mechanism for a bed deck rotatably mounted to a bed platform, for movement of the bed deck from a substantially horizontal to a non-horizontal position, including: a rotating means for rotating with a first end of a torsion bar to induce a force into the bed deck; an affixing means for affixing a second end of the torsion bar to the bed platform; a limiting means for limiting the rotation of the rotating means; and an adjusting means for adjusting the force induced into the bed deck, wherein the force induced into the bed deck moves the bed deck from the substantially horizontal position to the non-horizontal position.

In still another embodiment, provided is a method for manufacturing a lifting mechanism for a bed deck rotatably mounted to a bed platform, for movement of the bed deck from a substantially horizontal to a non-horizontal position, including: affixing an anchor arm to the bed platform; mating a first end of a torsion bar with a cam follower; integrating a second end of the torsion bar to the anchor arm; interfacing the cam follower with a loading cam mounted to the bed deck to induce a load in the torsion bar and rotate the cam follower; securing the cam follower in a loaded position; replacing the loading cam with a cam; and rotatably attaching the bed deck to the bed platform.

DETAILED DESCRIPTION

Figure 1:
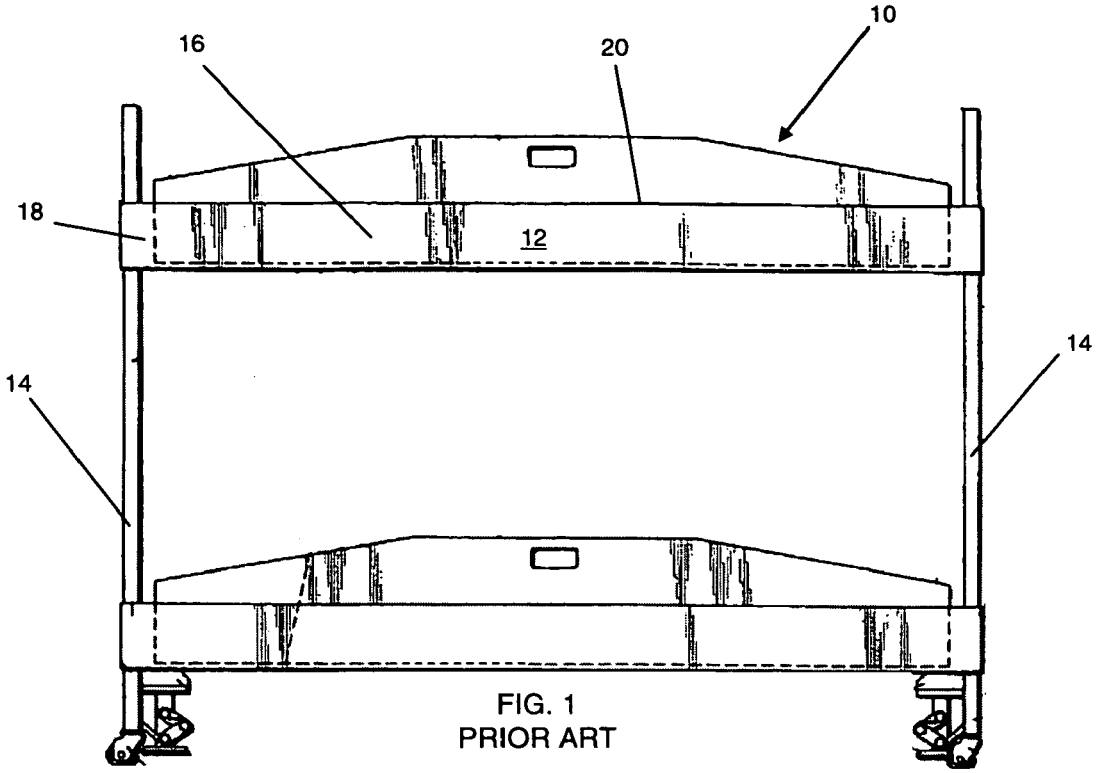
FIG. 1 PRIOR ART
FIG. 1 is a side view of a prior art bedding assembly.
Figure 2:
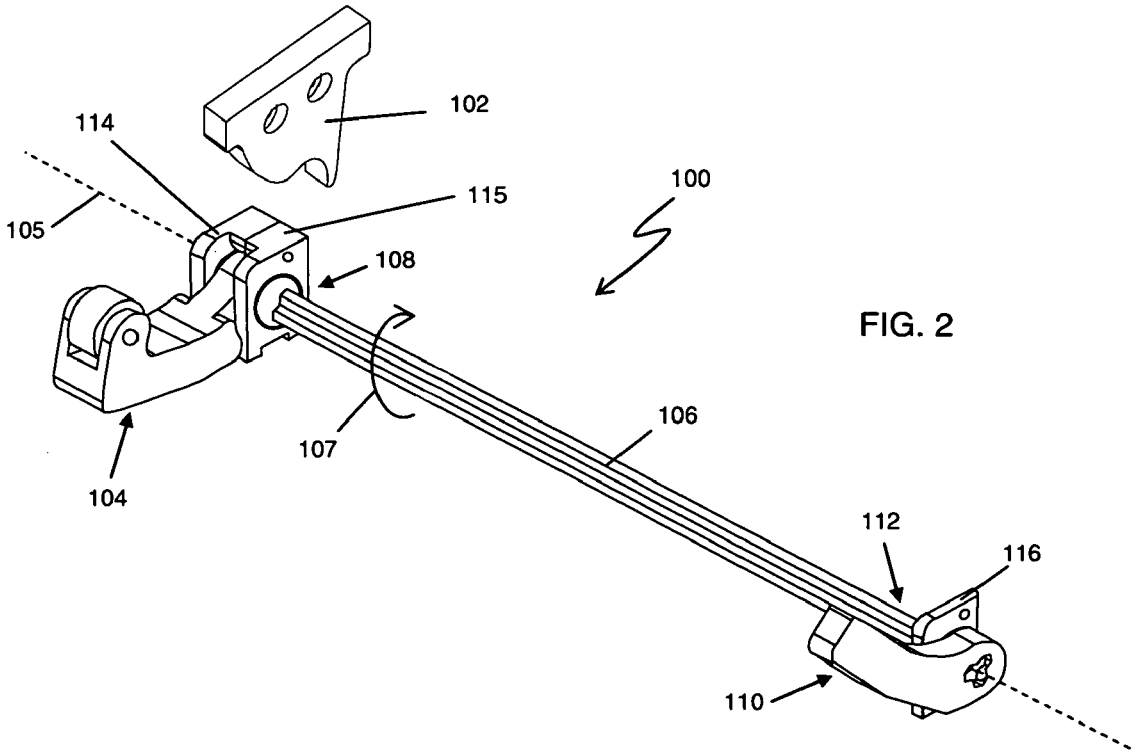
FIG. 2 is a perspective view of the lifting mechanism in accordance with an embodiment of the present invention.
Figure 5:
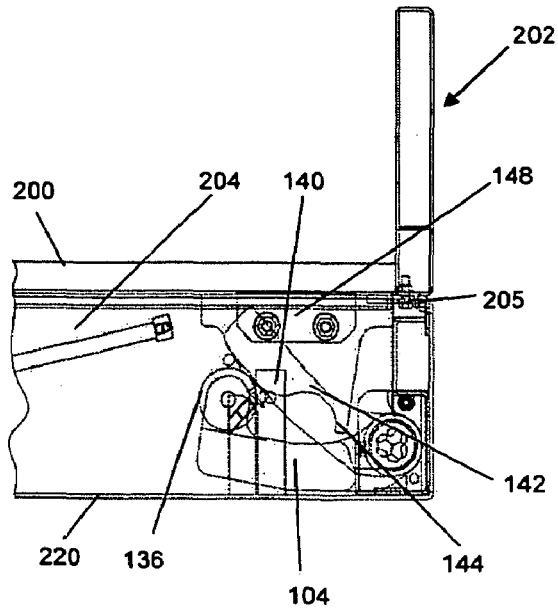
FIG. 5 is a partial cross-sectional view of the platform and deck of the present invention showing the deck in horizontal position in accordance with an embodiment of the present invention.

FIG. 2 shows the lifting mechanism 100 of the present embodiment removed from mounting within the recessed storage area 204 (FIG. 5) of the bed platform 202 (FIG. 5). Cam 102 is shown as well for reference. The lifting mechanism 100 comprises generally the torsion bar or rod 106 with the cam follower 104 rigidly mounted to a first end 108 of the torsion bar 106 and an anchor arm 110 rigidly mounted to a second end 112 thereof. When mounted with the bed platform 202, the torsion bar 106 axis 105 extends generally in the horizontal plane and defines a lateral direction.

Despite the fact that the mounting of the cam follower 104 with the torsion bar 106 is typically rigid, the cam follower 104 is able to rotate about the axis 105 of the torsion bar 106 due to the twisting of the bar 106 in torsion; the twisting of the torsion bar 106 is at a maximum at the first end 108 of the torsion bar 106 where the cam follower 104 is mounted. In the embodiment shown in FIG. 2, the rotational force applied by the cam follower 104 is in a clockwise direction around the axis of the torsion bar 106, as evidenced by arrow 107. The anchor arm 110 provides a brace to prevent the torsion bar 106 from untwisting at the second end 112 thereof and releasing the torque built up in the torsion bar 106 by rotation of the cam follower 104.

Figure 3:
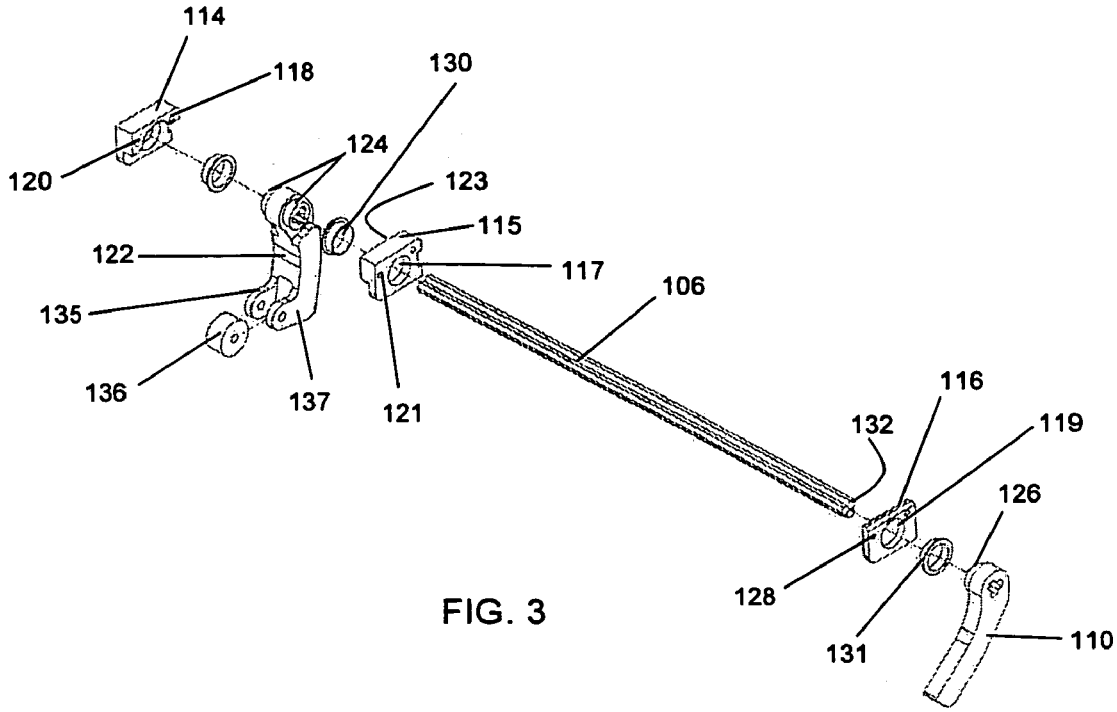
FIG. 3 is an exploded view of the lifting mechanism in accordance with an embodiment of the present invention.

To anchor the torsion bar 106, the cam follower 104 and anchor arm 110 mounted thereon to the bed platform 202, a pair of mounting blocks 114, 115 and a mounting plate 116 are fit onto the cam follower 104 and the anchor arm 110, respectively, and generally surround the torsion bar 106 through central holes 117 and 119 therein, as seen in FIG. 3. Referring to FIG. 3, the mounting blocks 114, 115 are preferably mirror-images of one another and have abutting mating surfaces 118 and 123 respectively. Bores, e.g. bore 120 and 121, extend laterally through the mounting blocks 114, 115 through which fasteners (not shown) may be inserted to secure the blocks 114, 115 together and to secure blocks 114, 115 to the bed platform 202, as explained more fully herein. In this way, the mounting blocks 114, 115 laterally sandwich a base 122 of the cam follower 104 therebetween while circumferentially surrounding bosses, e.g. boss 124, of the base 122 through which the torsion bar 106 first end 108 extends. Similarly, the mounting plate 116 is configured to circumferentially surround a boss 126 of the anchor arm 110 through which the torsion bar 106 second end 112 extends. Bores, e.g. bore 128, extend laterally through the mounting plate 116 through which fasteners (not shown) extend to secure the plate 116 to the bed platform 202. Additionally, sleeve bearings e.g. bearings 130 and 131, are press fit into the central holes, e.g. central hole 117, of the mounting blocks 114, 115 and the central hole 119 of mounting plate 116 respectively, and are configured to surround the bosses 124, 126 to carry the torsional load on the cam follower 104 and the anchor arm 110 while allowing relatively free rotation of the follower 104 and arm 110 with respect to the blocks 114, 115 and the plate 116, respectively.

As best seen in FIG. 3, the torsion bar or rod 106 is preferably formed by affixing multiple elongate hexagonal rods 132 together along longitudinal surfaces thereof such that each rod contacts at least two other rods. Three hexagonal rods 132 are shown in the embodiment of FIG. 3, but any number could be used as a matter of design choice depending on the desired strength and torsional rigidity of the torsion bar 106, as well as the force necessary to lift and rotate the bed deck 200 (FIG. 5) hingedly mounted with the bed platform 202. The bosses 124, 126 of the mounting blocks 114, 115 and the mounting plate 116, respectively, are shaped with a cross-section configured to accept the torsion bar 106.

Figure 4:
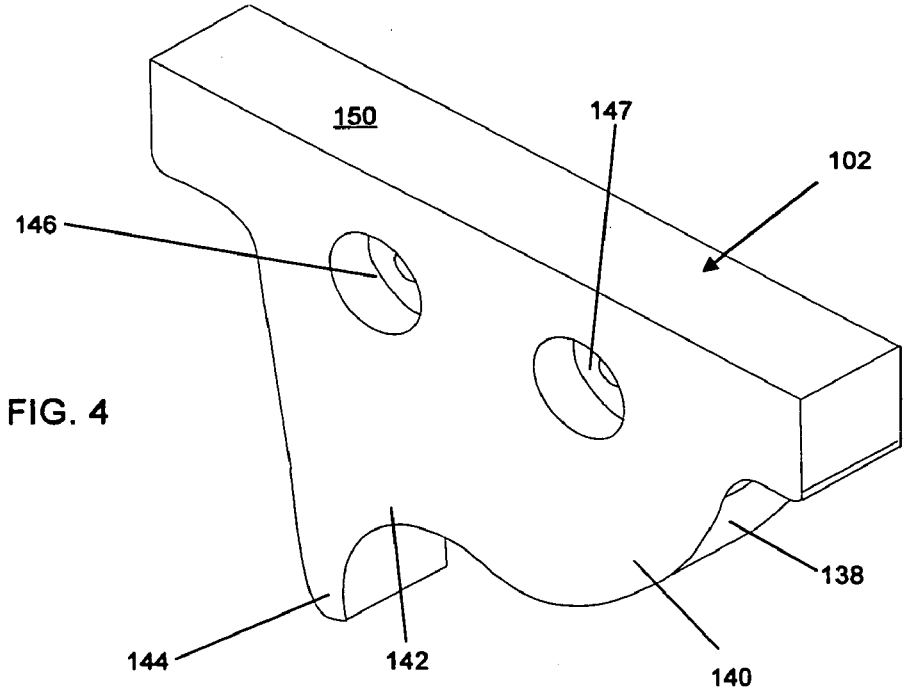
FIG. 4 is a perspective view of the cam in accordance with an embodiment of the present invention.

The cam follower 104 has a pair of flanged ears 135 and 137 on an end opposite of the base 122, and a roller 136 rotatably mounted with the ears 135, 137. The roller 136 allows the cam follower 104 to pass along the engaging surface 138 (FIG. 4) of the cam 102 (FIG. 4) with minimal friction while transferring the torsional load generated by the torsion bar 106 as a point load onto the cam 102. FIG. 4 shows one embodiment of the cam 102. The engaging surface 138 is formed by a central convex region 140 that transitions into a lower concave region 142 which terminates in a stop 144.

Figure 6:
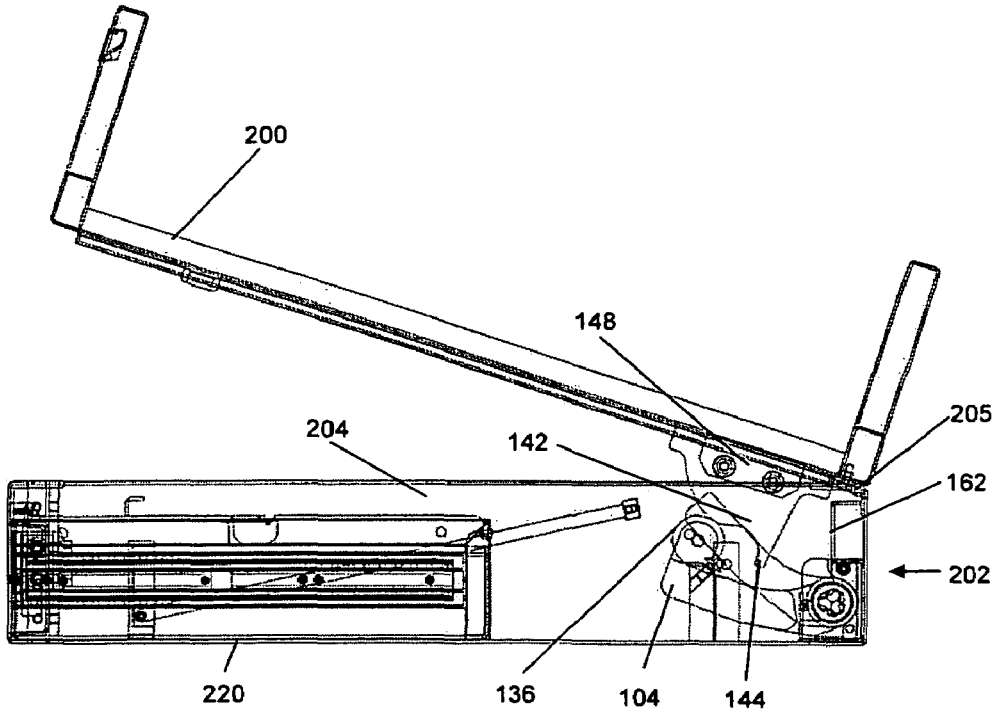
FIG. 6 is a cross-sectional view of the platform and deck of the present invention showing the deck in a non-horizontal position in accordance with an embodiment of the present invention.
Figure 7:
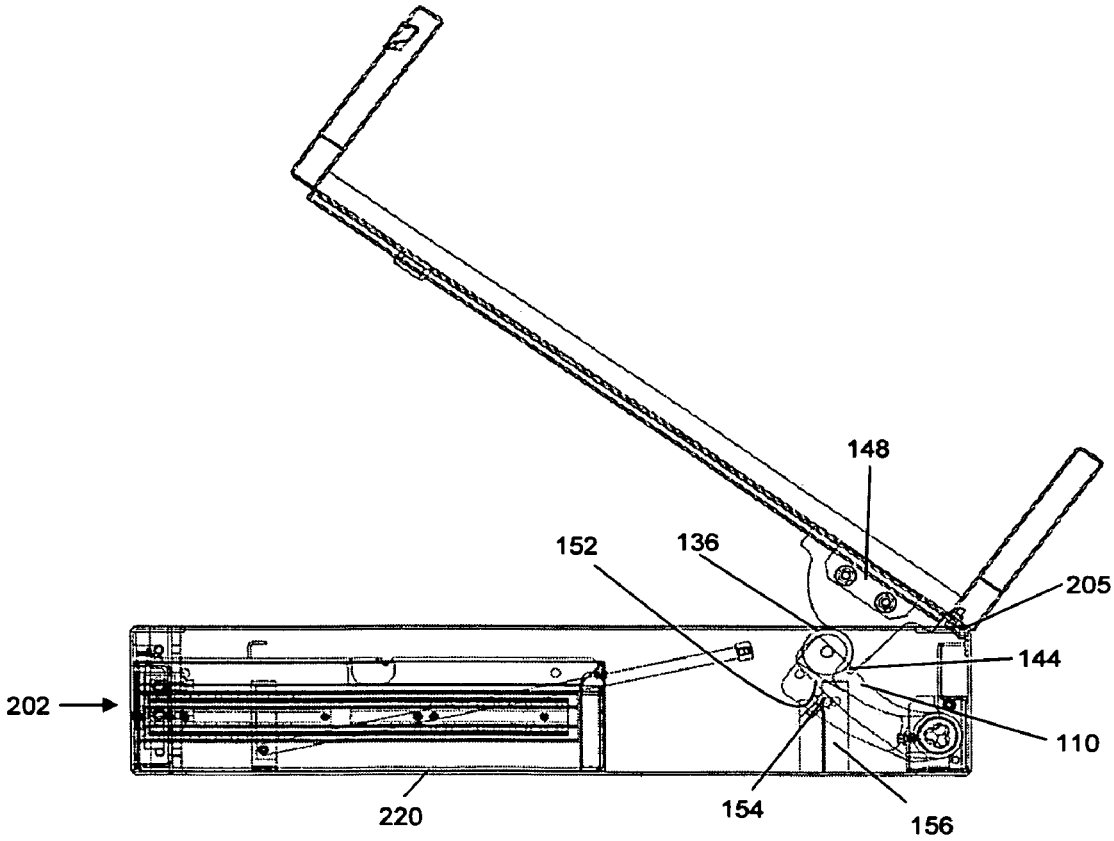
FIG. 7 is a cross-sectional view of the platform and deck of the present invention showing the deck in a non-horizontal position in accordance with an embodiment of the present invention.

As shown in FIGS. 5 and 6, the convex region 140 is contacted by the cam follower 104 when the bed deck 200 is in substantially the horizontal position overlying the recessed storage area 204 of the bed platform 202 and as the deck 200 rotates upward about a hinge 205 for a distance. With continued upward rotation of the bed deck 200, the roller 136 of the cam follower 104 enters the concave region 142 and continues therein until reaching the stop 144, as best seen in FIG. 7. The stop 144 forms the outer edge of the concave region 142, a region 142 with a radius that lowers in value until the radius is as small as the radius of the roller 136. Roller 136 is effectively locked from continuing down the engaging surface 138 (FIG. 4), thereby affixing the upward rotation limit for the bed deck 200. The cam 102 has generally two laterally extending bores 146 and 147, best seen in FIG. 4, for mounting of the cam 102 with fasteners to a bracket 148 affixed to the bed deck 200, as best seen in FIGS. 5–7. A flat upper surface 150 (FIG. 4) of the cam 102 is mounted against the deck 200 to transfer the point load applied by the cam follower 104 to the deck 200.

As best seen in FIG. 7, the anchor arm 110 has a lower surface 152 that contacts a force adjusting screw 154 and transfers the reactive torque at the second end 112 (FIG. 2) of the torsion bar 106 (FIG. 2) opposite of the torque on the cam follower 104 (FIG. 2) to the screw 154. The screw 154 is threadingly mounted to a brace or fixed bracket 156 on the bed platform 202 that is configured to spread the reactive torsion load in the torsion bar 106 across a reinforced surface area of the platform 202. The screw 154 may be rotated to change the angle of the anchor arm 110 about the torsion bar axis 105 relative to the angle of the cam follower 104 about the torsion bar axis 105, which increases or decreases—depending on the direction of screw 154 rotation—the force applied by the cam follower 104 to the cam 102.

Figure 8:
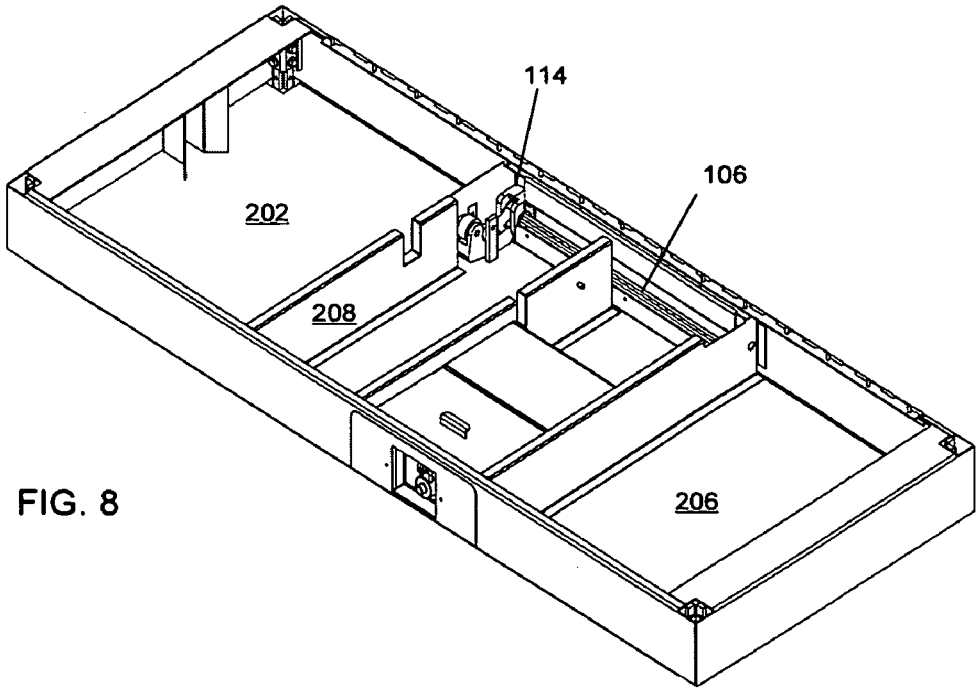
FIG. 8 is a perspective view of the platform with the lifting mechanism of the present invention, and the deck removed.
Figure 9:
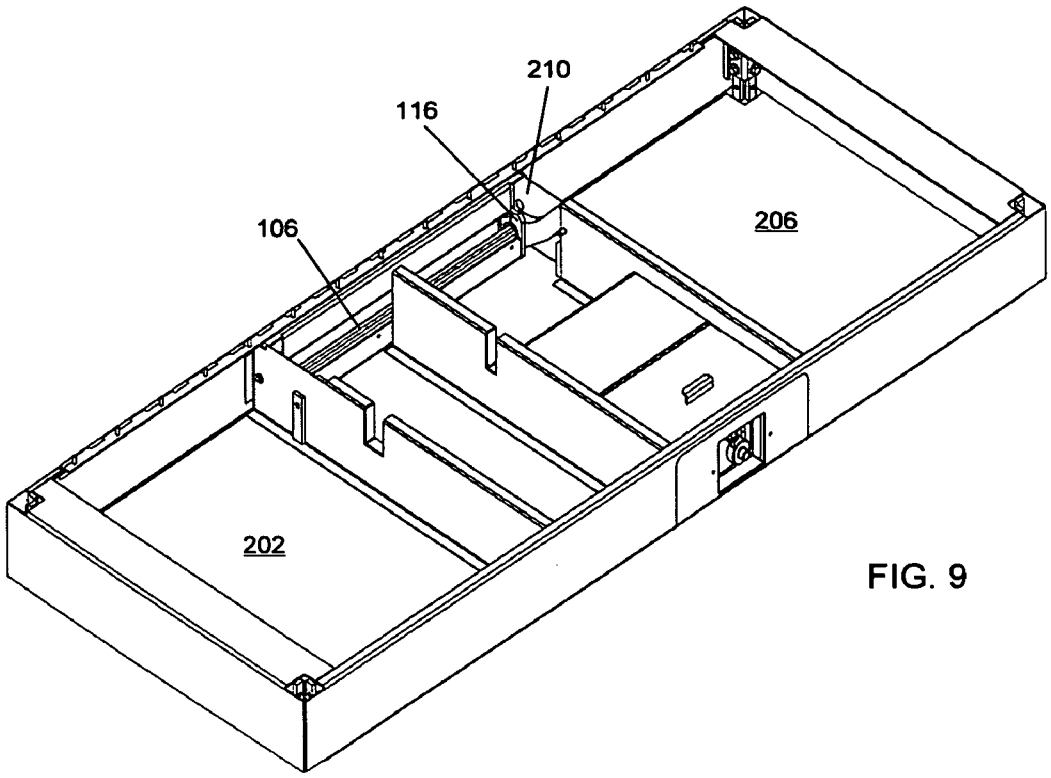
FIG. 9 is a perspective view of the platform with the lifting mechanism of the present invention, and the deck removed.

FIGS. 8 and 9 show views of one bed platform 202 with the deck 200 removed for better viewing of the lifting mechanism 100. The mounting blocks, e.g. block 114 (FIG. 8), and mounting plate 116 (FIG. 9) may, in one embodiment, be attached with fasteners to dividers 208, 210, respectively, extending orthogonally with respect to the torsion bar 106 across the base surface 206 of the bed platform 202.

Figure 10:
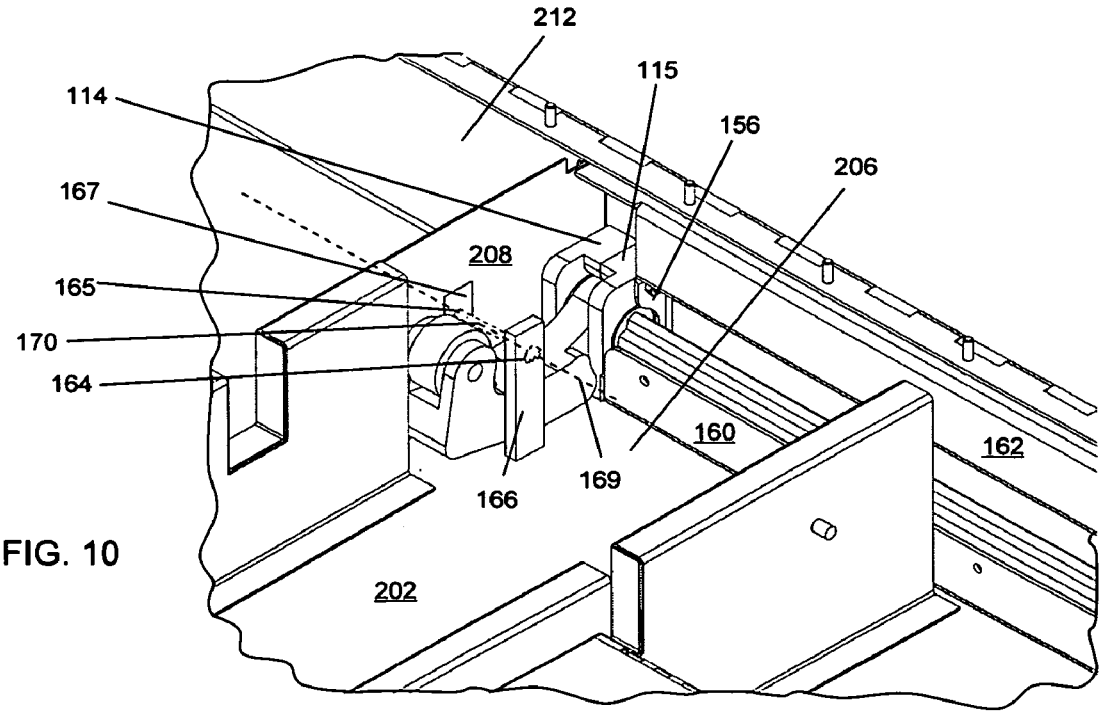
FIG. 10 is a partial perspective view of one side of the lifting mechanism as mounted to the bed platform within the recessed storage area, in accordance with an embodiment of the present invention.
Figure 11:
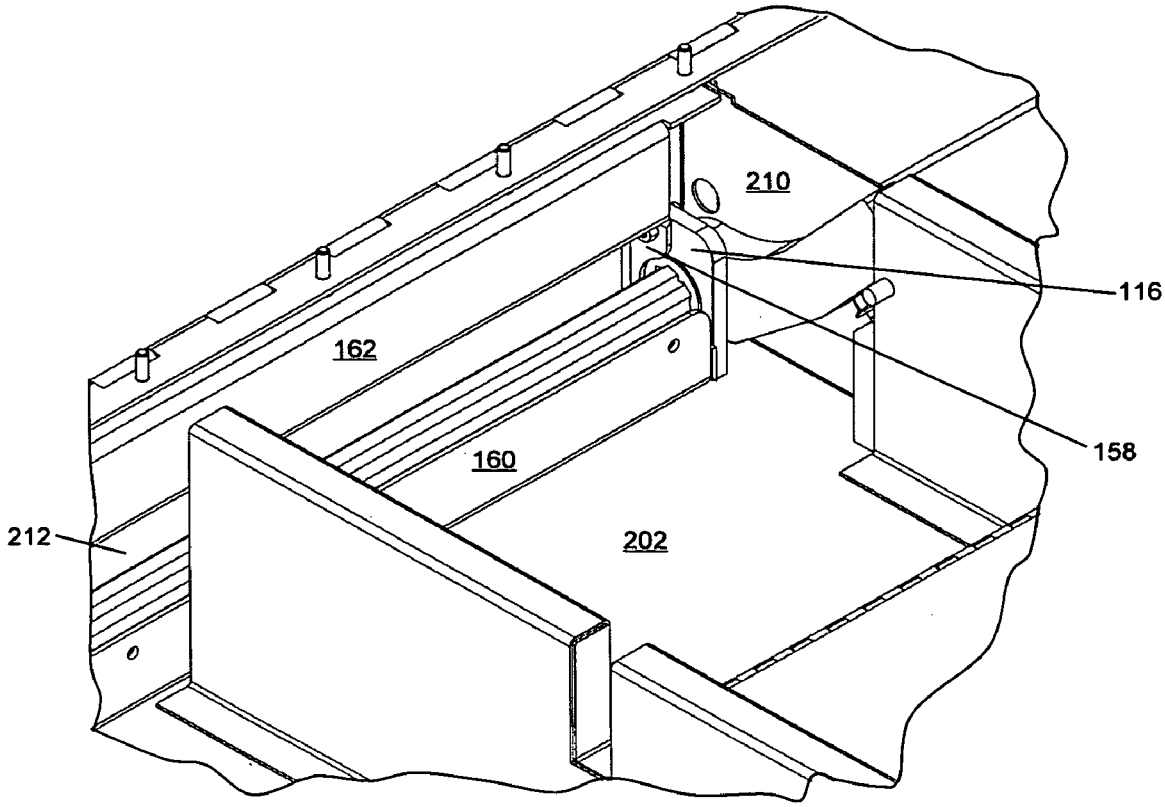
FIG. 11 is a partial perspective view of a second side of the lifting mechanism as mounted to the bed platform within the recessed storage area in accordance with an embodiment of the present invention.

FIGS. 10 and 11 show close-up views of a section of FIGS. 8 and 9, respectively, where the lifting mechanism 100 is seen mounted to the bed platform 202. In at least one embodiment, as shown in FIG. 10, a first C-shaped bracket 156 is affixed on edges thereof to a back wall 212 and the base surface 206 of the bed platform 202, such that the mounting blocks 114, 115 may be mounted to the bracket 156 with fasteners through bores, e.g. bore 120 (FIG. 3) in the blocks, e.g. 114, between the bracket 156 and the divider 208. Two additional mounting brackets 166 and 167 may be used to help secure cam follower 104 to bed platform 202. Brackets 166, 167 have aligned bore holes 164 and 165 respectively. Likewise, as shown in FIG. 11, a second C-shaped bracket 158 is affixed to the surfaces of the bed platform 202 in substantially the same manner as the first bracket 156, such that the mounting plate 116 may be mounted to the bracket 158 with fasteners through bores, e.g. bore hole 128 (FIG. 3) in the plate 116 between the bracket 158 and the divider 210. To further stabilize the first and second C-shaped brackets 156, 158, a vertical brace 160 may be mounted to the base surface 206 to span the lateral dimension between the brackets 156, 158. Also, a channel brace 162, with a cross-section best seen in FIG. 6, may be mounted to the back wall 212 of the bed platform 202 to abut the top of the brackets 156, 158 and provide further stabilization thereof.

When initially loading the torsion bar 106 with the necessary torsion for lifting the bed deck 200, the cam follower 104 should be secured in a "loaded" position. To accomplish this, a loading cam (not shown) with dimensions larger than the cam 102 is first mounted to the bed deck 200 which is mounted to the bed platform 202. The bed deck 200 is then lowered to the horizontal position such that the weight of the bed deck 200 loads the bar 106 with torsion. Once the body or center section of the cam follower 104 passes below an axis 169 (FIG. 10) formed between bores 164 and 165 of adjacent loading brackets 166 and 167 (the loading cam being shaped not to block this axis as it is contacting the cam follower roller 136), a pin 170 (shown in phantom in FIG. 10) may be inserted through both bore holes 164, 165 to hold the loaded cam follower 104 in place. The bed deck 200 may then be lifted and the loading cam replaced with the cam 102 used for standard operation. At that point, the deck 200 is again lowered to the horizontal position, this time with the engaging surface 138 of the cam 102 contacting the cam follower roller 136. Once contact is established and the load is taken off of the loading bracket pin 170, the pin 170 can be removed and the bed deck 200 and bed platform 202 are ready for use.

Figure 12:
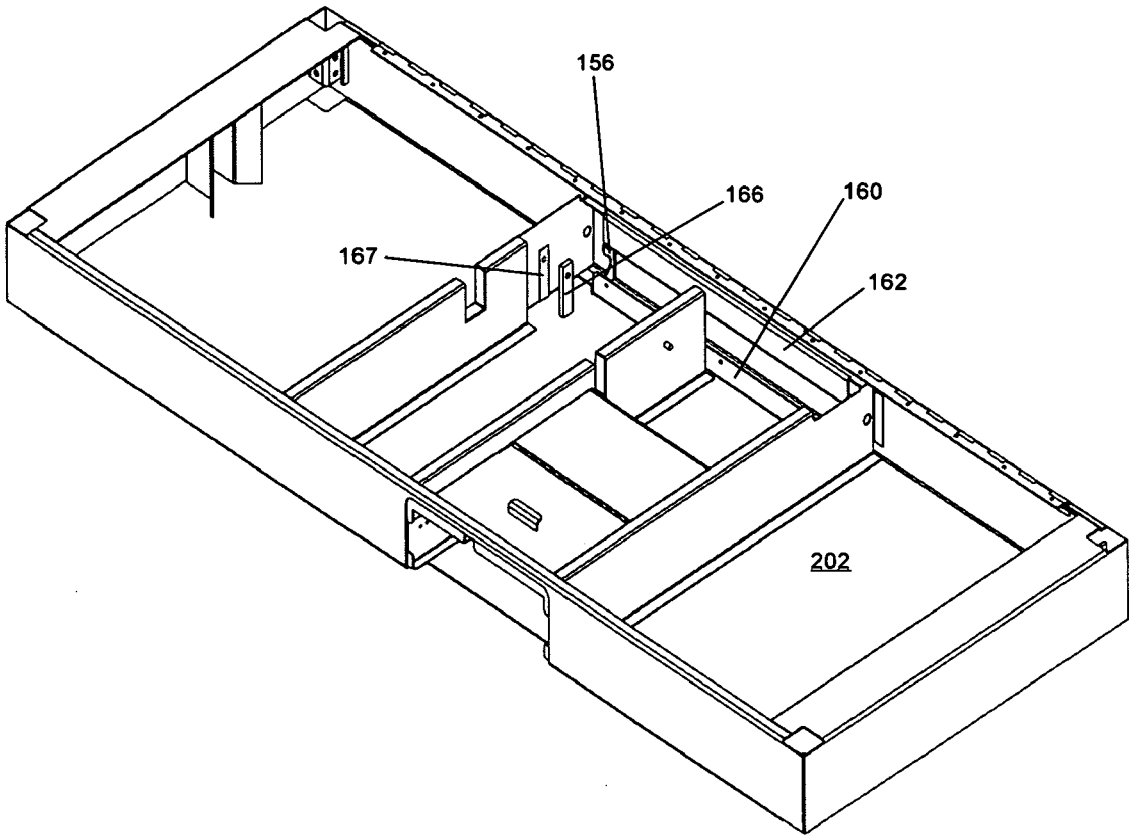
FIG. 12 is a perspective view of the bed platform with the lifting mechanism removed.

FIG. 12 is a similar view as that of FIG. 8, but with the torsion bar 106, the cam follower 104, the anchor arm 110, the mounting blocks 114, 115 and the mounting plate 116 removed. The position of the loading brackets 166, 167, the C-shaped bracket 156, the vertical brace 160, and the channel brace 162 is best seen in relation to the overall configuration of the bed platform 202 in FIG. 12.

Observing the motion of the bed deck 200 in FIGS. 5–7, it can be appreciated that as the deck 200 is rotated upward from the horizontal position, the center of gravity CG of the deck 200 moves towards a vertical plane (not shown) or position substantially normal to surface 220. Thus, less of a moment exists that must be overcome by the point load applied by the cam follower 104. Consequently, when the deck 200 is at or near the horizontal position, the cam follower 104 is rotated to a lower position corresponding to increased torsion in the torsion bar 106. As the deck 200 rotates upward, FIGS. 6 and 7, the cam follower 104 likewise rotates upward, because of the shape of the cam engaging surface 138, thereby decreasing the torsion in the torsion bar 106; the decreased torsion is desired because of the lower moment needed to support the bed deck 200 at the rotated position in force equilibrium. If the cam engaging surface 138 is properly dimensioned, and the weight of the bed deck 200 is known, the point load applied to the deck 200 by the cam follower 104 will equal the moment produced by the deck 200, hence force equilibrium, and the deck 200 can be suspended at any angle of rotation without having to hold or brace the deck 200. Even if additional items are placed on the deck 200, increasing the moment, if the weight of these items is small compared to the weight of the deck 200, only a small lifting force will be necessary to lift the deck 200 and expose the recessed storage area 204.

It should also be understood that the key lifting components of the lifting mechanism 100 may be reversed in position. In this arrangement, the torsion bar 106 is mounted on the undersurface of the bed deck 200 with the cam follower 104 and anchor arm 110 affixed on the bar 106 and facing a direction opposite of that shown in FIGS. 8–11. Likewise, the flat upper surface 150 of the cam 102 becomes a bottom surface mounted against the platform base surface 206 such that the cam 102 faces upward for engagement with the cam follower 104 facing downward.

Changes may be made in the above methods, devices and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, device and structure, which, as a matter of language, might be said to fall therebetween.

What is claimed is:

1. A lifting mechanism (100) for a bed deck (200), the bed deck (200) being rotatably mounted to a bed platform (202) for movement of the bed deck (200) from a substantially horizontal to a non-horizontal position, comprising:

a torsion bar (106) having a first end (108) and a second end (112) and defining an axis (105);

a cam follower (104) mounted on the torsion bar (106) proximal to the first end (108);

an anchor arm (110) mounted on the torsion bar (106) proximal to the second end (112); and a cam (102) mounted to the bed deck (200); and a force adjusting screw (154) threadably mounted to the bed platform (202);

wherein a torsional force applied to the torsion bar (106) by rotation of the cam follower (104) about the axis (105) of the torsion bar (106), relative to a position of the anchor arm (110), is transferred by the cam follower (104) to the cam (102) to provide a biasing force to the bed deck (200) in the direction of rotation, to move the bed deck (200) from a substantially horizontal to a non-horizontal position; and wherein rotation of the force adjusting screw (154) changes the angle of the anchor arm (110) relative to the position of the cam follower (104) to adjust the biasing force applied to the bed deck (200).

2. A lifting mechanism (100) for a bed deck (200), the bed deck (200) being rotatably mounted to a bed platform (202)

for movement of the bed deck (200) from a substantially horizontal to a non-horizontal position, comprising:

a torsion bar (106) having a first end (108) and a second end (112) and defining an axis (105);

a cam follower (104) mounted on the torsion bar (106) proximal to the first end (108);

an anchor arm (110) mounted on the torsion bar (106) proximal to the second end (112); and a cam (102) mounted to the bed deck (200);

at least one boss (124) integral to the cam follower (104);

at least one boss (126) integral to the anchor arm (110);

at least one mounting block (115) in proximity to the first end (108) having a central hole (117) therethrough;

a sleeve bearing (130) fit within the central hole (117) of the at least one mounting block (115) and having an inner diameter sized to receive the at least one boss (124) of the cam follower (104);

a mounting plate (116) having a central hole (119) therethrough;

a sleeve bearing (131) fit within the central hole (119) of the mounting plate (116) and having an inner diameter sized to receive the at least one boss (126) of the anchor arm (110);

a first bracket (156) to which the at least one mounting block (115) is mounted; and a second bracket (158) to which the mounting plate (116) is mounted;

wherein a torsional force applied to the torsion bar (106) by rotation of the cam follower (104) about the axis (105) of the torsion bar (106), relative to a position of the anchor arm (110), is transferred by the cam follower (104) to the cam (102) to provide a biasing force to the bed deck (200) in the direction of rotation, to move the bed deck (200) from a substantially horizontal to a non-horizontal position.

3. The lifting mechanism (100) of claim 2, wherein the torsion bar (106), the cam follower (104) and the anchor arm (110) are mounted to the bed platform (202).

4. The lifting mechanism (100) of claim 2, wherein the torsion bar (106), the cam follower (104) and the anchor arm (110) are mounted to the bed deck (200).

5. The lifting mechanism (100) of claim 4, wherein the cam (102) is mounted to the bed platform (202).

6. The lifting mechanism (100) of claim 2, wherein the cam (102) has an engaging surface (138) that is contacted by the cam follower (104) to transfer the torsional force to the cam (102) as a point load, such that as the bed deck (200) is rotated to a non-horizontal position the point load is reduced to suspend the bed deck (200) in force equilibrium.

7. The lifting mechanism (100) of claim 1, further comprising:

a vertical brace (160) affixed to the bed platform (202) and positioned between the first bracket (156) and the second bracket (158); and a channel brace (162) affixed to the bed platform (202) and positioned to abut the first bracket (156) and the second bracket (158).

8. A lifting mechanism (100) for a bed deck (200) rotatably mounted to a bed platform (202), for movement of the bed deck (200) from a substantially horizontal to a non-horizontal position, comprising:

a rotating means for rotating with a first end (108) of a torsion bar (106) to induce a force into the bed deck (200);

an affixing means for affixing a second end (112) of the torsion bar (106) to the bed platform (202);

a limiting means for limiting the rotation of the rotating means; and an adjusting means for adjusting the force induced into the bed deck (200)

wherein the force induced into the bed deck (200) moves the bed deck (200) from the substantially horizontal position to the non-horizontal position.

9. The lifting mechanism (100) of claim 8, wherein the affixing means is an anchor arm (110).

10. The lifting mechanism (100) of claim 8, wherein the rotating means is a cam follower (104).

11. The lifting mechanism (100) of claim 8, wherein the limiting means is a cam (102).

12. The lifting mechanism (100) of claim 8, wherein the adjusting means is a force adjusting screw (154).

13. A method for manufacturing a lifting mechanism (100) for a bed deck (200) rotatably mounted to a bed platform (202), for movement of the bed deck (200) from a substantially horizontal to a non-horizontal position, comprising:

affixing an anchor arm (110) to the bed platform (202);

mating a first end (108) of a torsion bar (106) with a cam follower (104);

integrating a second end (112) of the torsion bar (106) to the anchor arm (110);

interfacing the cam follower (104) with a loading cam mounted to the bed deck (200) to induce a load in the torsion bar (106) and rotate the cam follower (104);

securing the cam follower (104) in a loaded position;

replacing the loading cam with a cam (102); and rotatably attaching the bed deck (200) to the bed platform (202).

14. The method of claim 7, wherein securing further comprises positioning a pin (170) in close proximity to the cam follower (104) to secure the cam follower (104) in the loaded position.

15. The method of claim 7, wherein the anchor arm (110), torsion bar (106) and cam follower (104) are mounted to the bed deck (200), and further wherein the loading cam and cam (102) are mounted to the bed platform (204).

* * * * *

UNITED STATES PATENT AND TRADEMARK OFFICE

CERTIFICATE OF CORRECTION

PATENT NO. : 7,367,069 B2
APPLICATION NO. : 10/855057
DATED : May 6, 2008
INVENTOR(S) : Michelle D. Connell et al.

It is certified that error appears in the above-identified patent and that said Letters Patent is hereby corrected as shown below:

Column 7, line 50, "of claim 1" should read --of claim 2--;
Column 8, lines 45 and 49, each occurrence of "method of claim 7" should read --method of claim 13--;

Signed and Sealed this

Seventh Day of October, 2008

JON W. DUDAS
*Director of the United States Patent and Trademark Office*